US006431909B1

(12) United States Patent
Nolden et al.

(10) Patent No.: US 6,431,909 B1
(45) Date of Patent: Aug. 13, 2002

(54) DIN RAIL ATTACHMENT METHOD AND APPARATUS

(75) Inventors: Paul T. Nolden, Rancine; Mark A. Kappel, Brookfield; Jeffrey R. Annis, Waukesha; Roy A. Rice, Milwaukee; Randall J. Slusar, Greenfield, all of WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 09/672,887

(22) Filed: Sep. 28, 2000

(51) Int. Cl.[7] ..... H01R 13/60
(52) U.S. Cl. ..... 439/532; 361/735; 361/810
(58) Field of Search ..... 361/807, 809, 361/810, 729, 730, 735, 634, 635, 636, 637; 439/94, 532, 716

(56) References Cited

U.S. PATENT DOCUMENTS 4,171,861 A * 10/1979 Hohorst ..... 439/94
5,249,979 A * 10/1993 Deinhard et al. ..... 439/341
5,480,310 A * 1/1996 Baum ..... 439/94
5,602,363 A * 2/1997 Von ..... 174/52.1
5,775,955 A * 7/1998 Graube et al. ..... 439/717
5,803,772 A * 9/1998 Muller et al. ..... 439/716
5,907,476 A * 5/1999 Davidsz ..... 361/732
6,172,875 B1 * 1/2001 Suzuki et al. ..... 361/729

* cited by examiner

*Primary Examiner*—Brian Sircus
*Assistant Examiner*—Thanh-Tam Le
(74) *Attorney, Agent, or Firm*—Tait R. Swanson; William R. Walbrun; Alexander M. Gerasimow

(57) ABSTRACT

A detachable securement apparatus for a mounting rail, wherein the mounting rail has first and second mounting flanges extending lengthwise along opposite sides of a support section. The apparatus has a body, a securement assembly and a release assembly. Extending from the body, the securement assembly has first and second interface members each including a contact region configured to exert a holding force on the first and second mounting flanges, respectively. The release assembly is configured for removing the holding force on both the first and second mounting flanges to allow vertical removal of the body. The release assembly has an engagement member coupled to the body and to the first and second interface members, and is engagable on a side of the body. A method of attachment and detachment with flanges of a rail mount assembly includes springably coupling first and second sides of a conductive mounting member to the first and second flange, laterally engaging a release actuator coupled to the mounting members, and simultaneously releasing the first and second sides of the mounting member from the flanges.

33 Claims, 6 Drawing Sheets

DIN RAIL ATTACHMENT METHOD AND APPARATUS

BACKGROUND OF THE INVENTION

1. Field Of The Invention

The present invention relates generally to the field of securement structures for aligning terminal blocks, input/output devices and other electrical components within enclosures and the like. More particularly, the invention relates to a self-locking, clip-in structure that can easily and quickly be mounted and removed straight on and off of a standard support rail, and that can be adapted for use as a terminal block or other device support.

2. Description Of The Related Art

A number of systems have been developed and are currently in use for mounting small components, particularly electrical components, in enclosures. Such systems include various conduit and rail structures useful for channeling wires to and from the components in a neat and orderly manner, facilitating installation and servicing. One popular system of this type is based upon a standard set of flanged rails that can be cut to a desired length and attached via screws to the interior of an enclosure. The rails, commonly referred to as "DIN" rails, have either inwardly or outwardly projecting raised flanges along their length for receiving the components. The components, including a wide array of modular elements such as terminal blocks, input/output modules, dip switches, small motor drives, contactors, circuit breakers, overload relays, communication/control modules, and so forth, feature corresponding structures designed to interface with the rail flanges to hold the components securely in place during installation and use.

Known component mounting structures include screw-down and screwless styles. Screw-down structures generally clip into place along the DIN rail and may be slid along the rail for positioning. A screw held over one of the rail flanges is then driven into the flange to anchor the component in place. In addition to the cost of the screw and associated holding elements, a disadvantage of these structures is the need to independently secure each component via the screw. This process is not only time consuming, but may result in misalignment on the rail due to twisting of the component under the influence of the screw-down torque. In many applications, therefore, the screwless mounting arrangements are often preferable.

The DIN rail attachment mechanism most commonly used is one with a fixed catch on one side and a moveable catch or snap on the opposite side. These arrangements typically include a component module having a hook-shaped rigid foot that is slipped over a first of the rail flanges, and a deformable leg that is then snapped over the opposite flange to secure the component to the rail. Because the modules are typically made of a moldable plastic material due to its good electrical insulation capabilities, metallic clips and the like are often provided in the rail interface features to bind the component more securely in place on the rail. For removal, the deformable leg may be bent free of the rail flange and the component may be removed by unhooking the rigid foot from the opposite flange. For these approaches, since one catch is fixed, DIN rail removal requires that the device must translate about 0.03–0.05 inches relative to the DIN rail after prying the opposite side. In many cases, a combined translation and rotational motion of the device relative to the DIN rail is required for removal.

In recent years a new generation of modular control and communication products has evolved for motor starter and other applications. These products being modular in nature, must make electrical connections to each other and may be DIN rail mounted within an enclosure. The electrical connections between modules could be achieved with separate plug-in connectors, but this approach would be very inefficient and costly. An effective method utilized to make these connections is to first design the modular housings such that they slide into each other from the top via a dovetail slot arrangement. Electrical connections are then made with mating contacts between the opposite housings that slide into contact as the two housings slide together.

The sliding dovetail arrangement produces an effective method for mechanical and electrical connections between modular housings but presents a major challenge for DIN rail mounting. Because with this approach the housings must slide off the DIN rail vertically with no lateral translation or rotation, traditional DIN rail release mechanisms will not work. Therefore, for the sliding dovetail approach to be effective, both catches or snaps must be released simultaneously. This then allows the module to be pulled straight off the DIN rail while sliding along adjacent modules on either side. An additional requirement of communication/control modules is that an electrical connection be made to the DIN rail for grounding and EMI noise issues.

While existing screwless DIN rail mounting structures provide an attractive solution to the problem of quickly and easily attaching components in desired rail locations, they are not without drawbacks. As noted above, existing mechanisms require considerable translational and/or rotational movement of the device to remove it from the DIN rail, and often lack a sufficient securement force to prevent lateral motion of the device. The requisite rotational movement may be disadvantageous in many applications. Furthermore, existing devices are often difficult to remove from the DIN rail due to this requisite rotational movement and the considerably high spring force in the deformable leg. For example, removal may be complicated where there is limited space, or where the point of access is limited. Due to the rotational movement, existing mechanisms also preclude the possibility of the sliding dovetail approach, discussed above, for attaching adjacent DIN rail devices. Existing DIN rail mounting structures also lack grounding mechanisms for electrical coupling to the DIN rail. As discussed above, existing structures are generally made of plastic, while only a limited amount of metal may be used in the hook shaped foot to enhance the securement force.

There is a need, therefore, for an improved arrangement for mounting components along DIN rails. The arrangement should be of a straightforward design that can be easily manufactured and assembled on the rail. In particular, there is a need for a DIN rail mounting structure that provides a straight attachment and removal mechanism. In accordance with this straight on/off mechanism, there is a further need for a grounding mechanism to complete an electrical connection to the DIN rail, an electrical-mechanical coupling mechanism for an adjacent module, and a superior holding force to prevent lateral movement while minimizing the number of different parts in the overall product.

SUMMARY OF THE INVENTION

The present technique features a detachable securement apparatus configured for a mounting rail, wherein the mounting rail has a first and second mounting flange extending lengthwise along opposite sides of a support section. The apparatus has a body, a securement assembly and a release assembly. Extending from the body, the securement assembly has first and second interface members, each including a contact region configured to exert a holding force on the first and second mounting flanges, respectively. The release assembly is configured for removing the holding force on both the first and second mounting flanges to allow vertical removal of the body. The release assembly has an engagement member coupled to the body and to the first and second interface members, and is engagable on a side of the body.

The technique also features a module mounting system for removably mounting to a mounting rail, wherein the rail has first and second mounting flanges extending lengthwise along opposite sides of a support section. The system includes a securement assembly and a vertical release assembly. The securement assembly has first and second spring-forced feet configured to exert a holding force on the first and second mounting flanges, respectively. The vertical release assembly includes a lateral actuator configured for simultaneously releasing the spring-forced feet from the mounting rail to allow vertical removal of the body.

A method is also contemplated for attachment and detachment with a rail mount assembly. The method includes springably coupling first and second sides of a conductive mounting member to the first and second flange of a mounting rail, respectively. The method also includes laterally engaging a release actuator coupled to the mounting member. The method also includes simultaneously releasing the first and second sides of the mounting member from the first and second flange, respectively.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
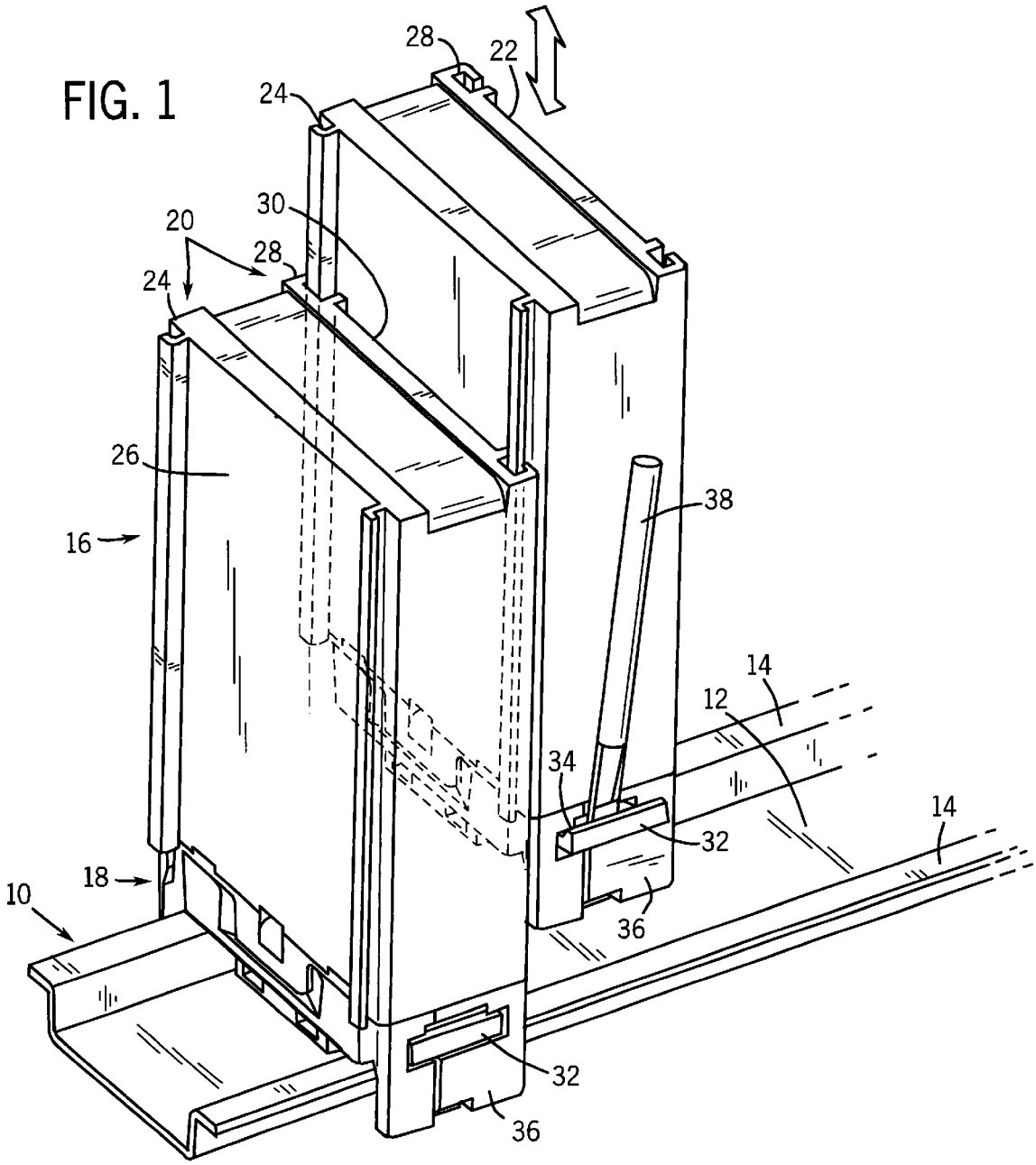
FIG. 1 is a perspective view of two slidably coupled modules having removable head assemblies, wherein one module is removably mounted to a DIN rail assembly, and the other module is vertically detached from the DIN rail assembly.

Turning now to the drawings, FIG. 1 is a perspective view of a DIN rail assembly having a base 12 and flanges 14 extending outwardly in an inverted L-shape from opposite sides of the base 12. A module 16 is coupled to the DIN rail assembly 10 via a head assembly 18, which snaps-on and secures to the flanges 14. The head assembly 18 permits attachment to the DIN rail assembly 10 by either a vertical motion, snapping-on to both flanges 14 simultaneously, or by a slight rotational motion, snapping-on to one flange 14 at a time. For removal, the head assembly 18 advantageously allows vertical disengagement from the DIN rail assembly 10. Thus, the head assembly 18 may be removed without any rotation or sliding along the flanges 14.

The module 16 also includes a rail assembly 20 for engagement with an adjacent module 22, which also includes the rail assembly 20. The adjacent module 22 may be identical, similar, or entirely different from the module 16, yet the rail assembly 20 advantageously provides a common mechanism to interlock multiple modules or desired devices. The rail assembly 20 includes a pair of rails 24 on a first side 26 of the module 16, and a pair of grooves 28 on an opposite side 30 of the module 16. Alternatively, the rail assembly 20 may have a single rail mechanism, multiple rails, or any other engagement mechanism allowing substantially linear engagement and interlocking between multiple modules or devices. The rails 24 are configured to slidably engage and interlock with the grooves 28. As illustrated in FIG. 1, the grooves 28 of the module 16 slidably interlock with the rails 24 of the adjacent module 22. The rail assembly 20 extends linearly along the module 16 from a top 32 of the module 16 to a base 34 of the module 16, at which point the module 16 removably couples to the head assembly 18. The rail assembly 20 advantageously allows slidable coupling to either side of the module 16, thereby providing flexibility in the placement of the adjacent module 22.

The rail assembly 20 is preferably configured for vertical alignment with the DIN rail assembly 10, such that the adjacent module 22 may slidably engage the module 16 and slide along the rail assembly 20, and vertically engage and snap-on to the DIN rail assembly 10. This vertical alignment advantageously permits multiple modules (or other devices) to be slidably interlocked, while also allowing an individual module to be vertically removed from a group of modules attached to the DIN rail assembly 10. The head assembly 18, as discussed above, allows vertical attachment and removal from the DIN rail assembly 10.

The head assembly 18 is released from the flanges 14 by engaging an actuator 32, which has an engagement lip 34 exposed on a side 36 of the head assembly 18. To engage the actuator 32, a flat elongated member 38 (such as a flat head screwdriver) is inserted into the engagement lip 34 and rotated to laterally move the actuator 32 outwardly from the side 36. Internally, this movement causes the head assembly 18 to release from both flanges 14, thereby allowing the head assembly 18 (and module 16 or adjacent module 22) to be vertically removed from the DIN rail assembly 10, as described below.

Figure 2:
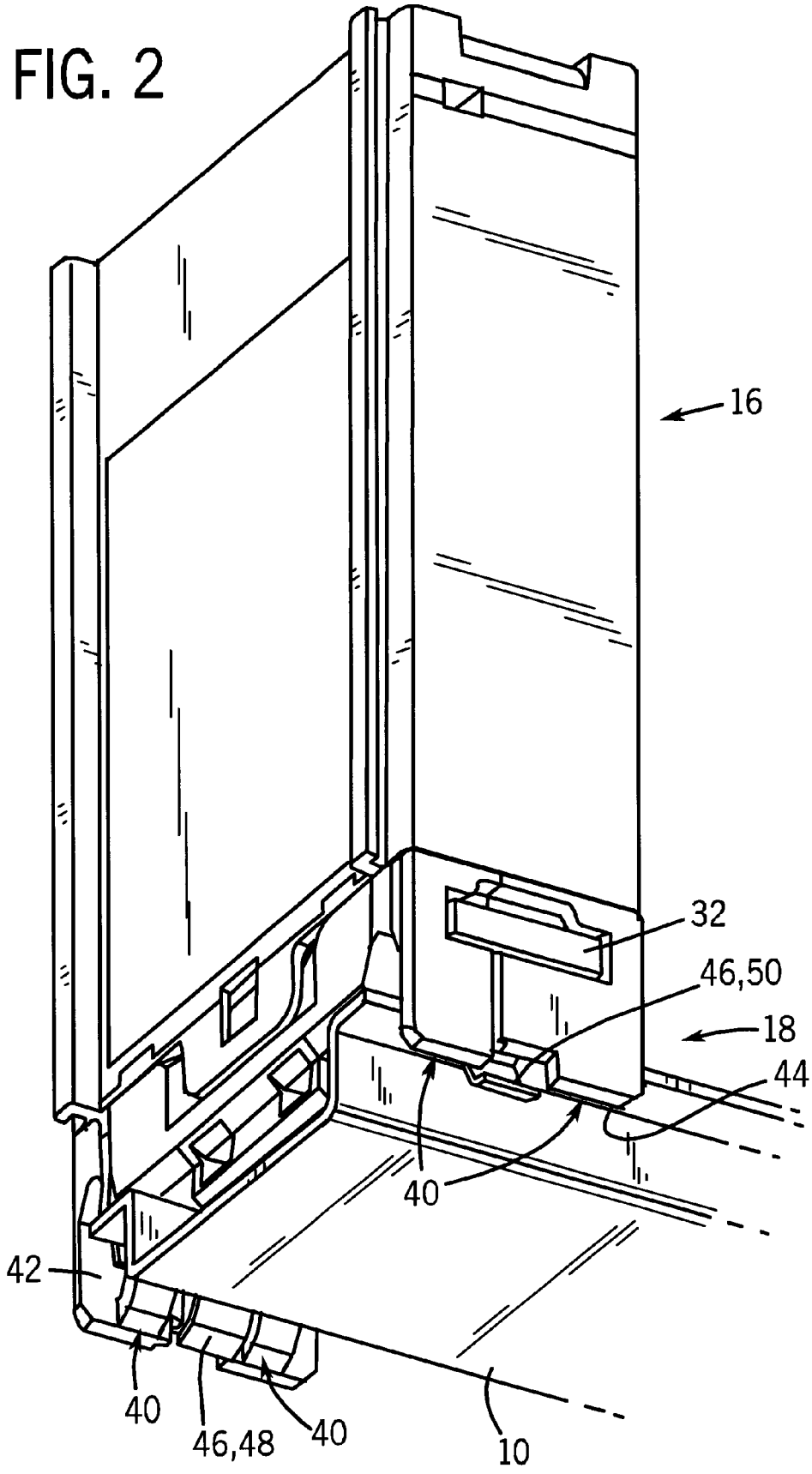
FIG. 2 is a perspective view of the module and head assembly coupled to the DIN rail assembly.

FIG. 2 illustrates a perspective view of the module 16 coupled to the head assembly 18. As illustrated, the head assembly 18 has resilient extensions 40 configured for springably engaging the flanges 14 of the DIN rail assembly 10. The extensions 40 are disposed in pairs on inner faces 42 and 44 of the head assembly 18. The extensions 40, which may be of any number or size depending on the application, are advantageously spring loaded due to their inherent elasticity to provide a compressive force on the flanges 14. This compressive force may also provide considerable resistance against lateral or sliding motion along the DIN rail assembly 10.

The head assembly 18 also has a snap spring 46, which has snap fingers 48 and 50 configured for snapping-on to the DIN rail assembly 10. The snap fingers 48 and 50 are disposed adjacent the inner faces 42 and 44, respectively, between pairs of the extensions 40. The snap fingers 48 and 50 prevent vertical removal of the head assembly 18 until the actuator 32 is engaged, as discussed below. The snap fingers 48 and 50 may also provide considerable resistance against lateral or sliding motion along the DIN rail assembly 10. Although FIG. 2 illustrates the actuator 32 frontwardly disposed, the extensions 40 and the snap fingers 48 and 50 are configured to allow coupling of the head assembly 18 with the DIN rail assembly 10 either as illustrated, or rotated 180 degrees. Thus, the actuator 32 may be rearwardly oriented with respect to the DIN rail assembly 10 by rotating the head assembly 18 with respect to the module (or by rotating the entire module and head assembly). This may advantageously improve accessibility to the actuator 32, or may be beneficial for other reasons.

Figure 3:
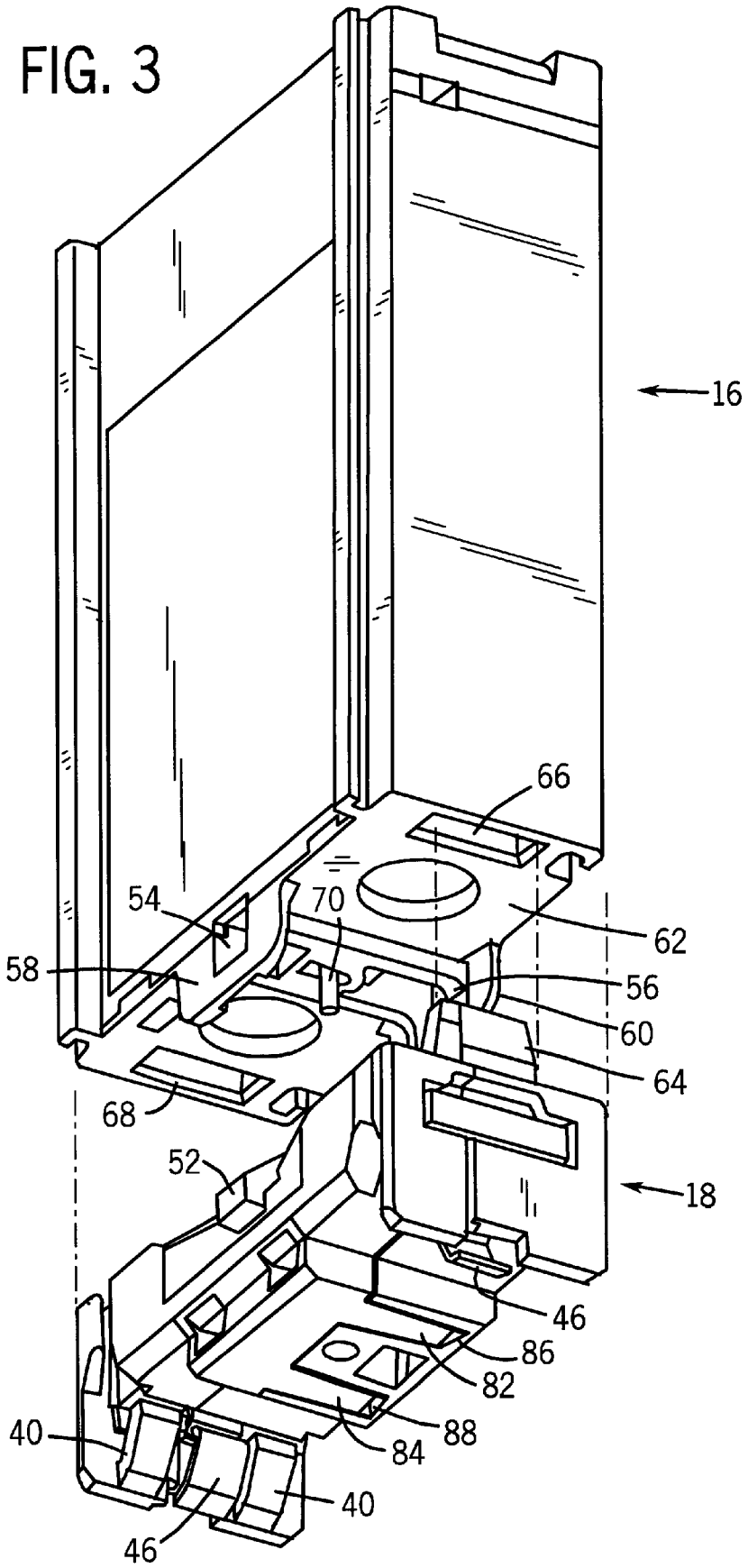
FIG. 3 is an exploded perspective view of the module and the head assembly.

FIG. 3 is a perspective exploded view of the module 16 and the head assembly 18. The module 16 and the head assembly 18 are removably attachable via a pair of snap tabs 52 on the head assembly 18 and snap windows 54 and 56 on the module 16. The snap windows 54 and 56 are disposed on tabs 58 and 60, which extend outwardly from a base 62 of the module 16. The head assembly 18 also has a pair of guide tabs 64, which are insertable into guide channels 66 and 68 in the base 62. The guide tabs 64 are advantageous as they guide the head assembly 18 onto the module 16. The guide tabs 64 may also provide other benefits, such as resistance against torque. As illustrated, the head assembly 18 is symmetrically configured to permit coupling between the module 16 and the head assembly 18 at two positions, either as illustrated in FIG. 3 or with the module 16 or head assembly 18 rotated 180 degrees.

To attach the head assembly 18 to the module 16, the guide tabs 64 are aligned and partially inserted into the guide channels 66 and 68, and then the head assembly 18 is pressed inwardly towards the base 62 until the snap tabs 52 securely snap-in to the snap windows 54 and 56. Removal may be achieved by either pressing the snap tabs 52 inwardly, or prying the tabs 58 and 60 outward, and then pulling the head assembly 18 away from the module 16. Again, the head assembly 18 may be rotated 180 degrees before attachment to the module due to the symmetrical orientation of the guide tabs 64 and snap tabs 52.

Figure 4:
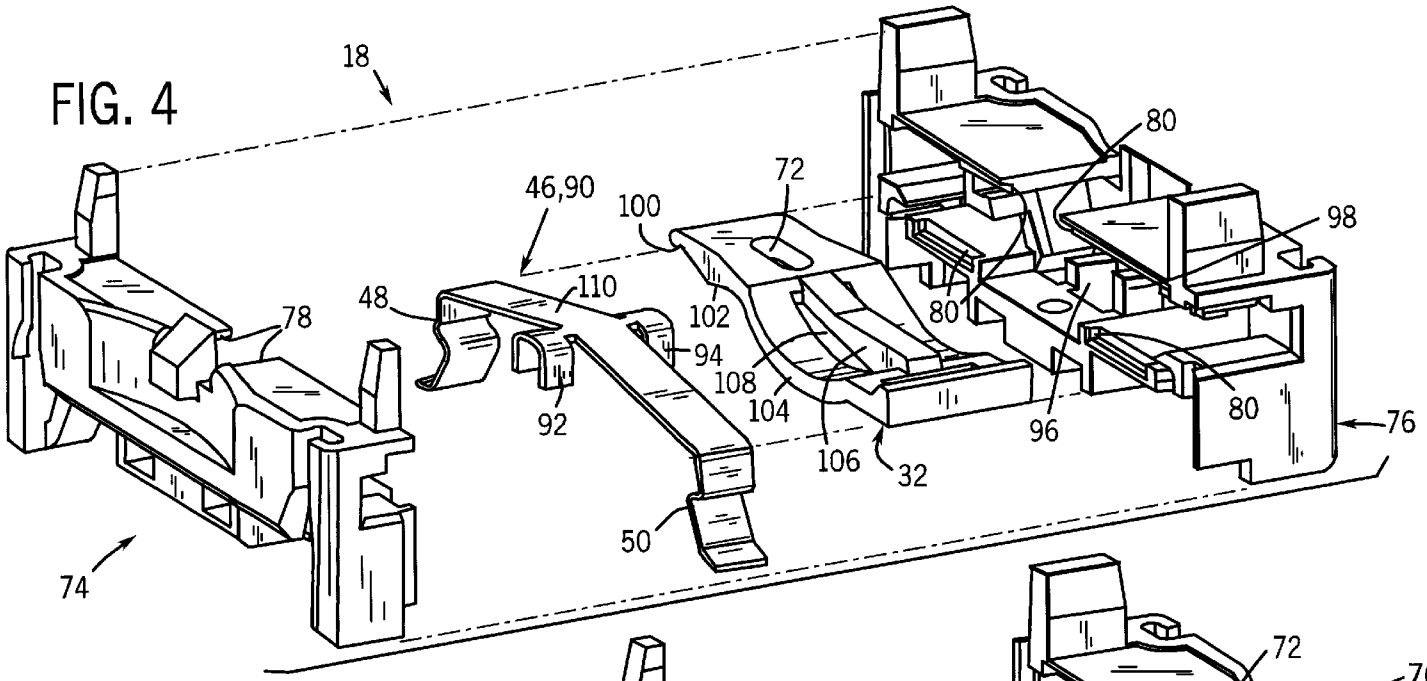
FIG. 4 is an exploded perspective view of the head assembly, illustrating the a first and second housing section, the snap spring and the actuator.
Figure 6:
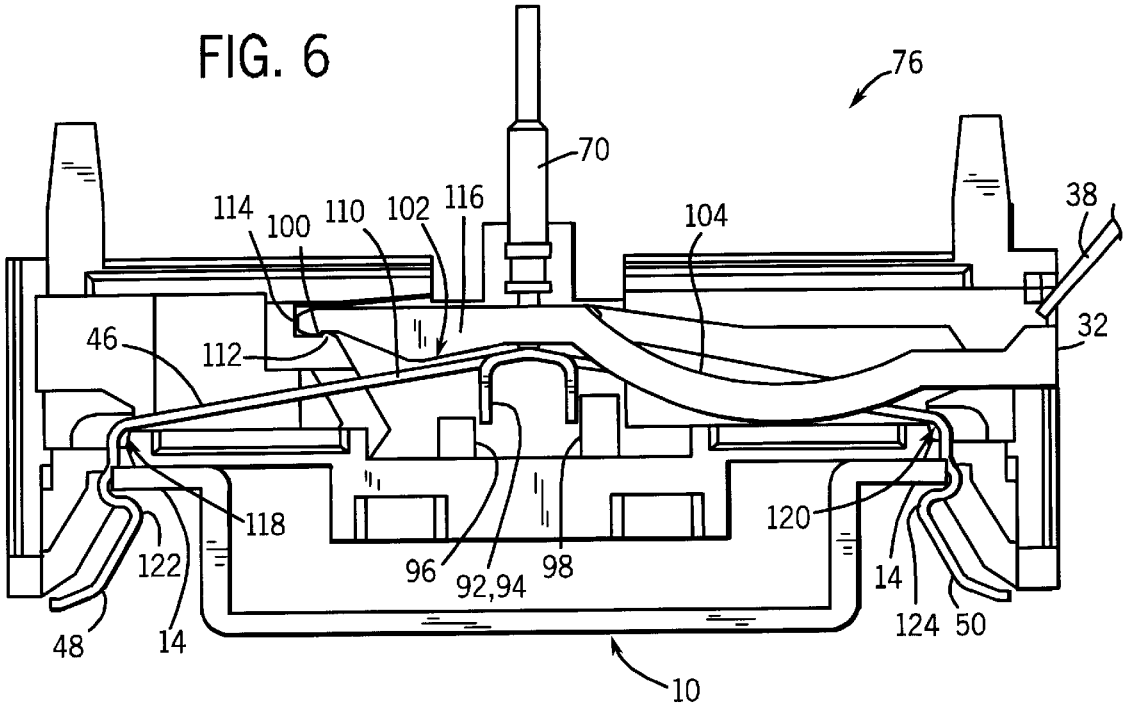
FIGS. 6 is a side view of the second housing section illustrating the orientation of the actuator and the snap spring in a relaxed state, wherein the head assembly has not been released from the DIN rail assembly.

The module 16 may also include a ground pin 70 for creating an electrical connection between internal components of the module 16 and the DIN rail assembly. The ground pin 70 is advantageously spring-loaded, and is configured to contact the snap spring 46 when the module 16 and the head assembly 18 are coupled. FIG. 6 illustrates the ground pin 70 in contact with the snap spring 46. Note also, as illustrated in FIG. 4, that the ground pin 70 is configured to extend through a slot 72 of the actuator 32. The ground pin 70 maintains contact with the snap spring 46, as the snap spring 46 moves, because of the spring-loaded mounting of the ground pin 70. Although the ground pin 70 is illustrated as in direct contact with the snap spring 46, the ground pin 70 may alternatively contact the snap spring 46 by an intermediate conductor mechanism, as desired in particular applications. Alternatively, the ground pin 70 may embody a fixed pin, rather than being spring-loaded, and then contact a spring mechanism in direct or indirect contact with the snap spring 46. The ground pin 70 may be coupled to the module 16 as illustrated, or alternatively, it may be coupled to the head assembly 18, and then springably contact a pad disposed on the module 16. Note also that the ground pin 70 is centrally disposed on the module 16, thereby maintaining the symmetry between the module 16 and the head assembly 18, as discussed above. As discussed above, this central positioning of the ground pin 70 allows the head assembly 18 to be coupled to the module 16 at two positions, either in the position shown, or rotated 180 degrees.

FIG. 4 is an exploded perspective view of the head assembly 18, illustrating housing sections 74 and 76, the snap spring 46 and the actuator 32. The housing sections 74 and 76 are aligned and coupled along ridges 78 on the housing section 74 and slots 80 on the housing section 76. The ridges 78 and the slots 80 advantageously maintain the proper alignment and fit between the housing sections 74 and 76, and may also provide additional stability and resistance to torque between the housing sections 74 and 76. Although the ridges 78 and the slots 80 may be configured to securely attach the housing sections 74 and 76, the illustrated embodiments include separate securement means. As illustrated in FIG. 3, the housing sections 74 and 76 are securely attached to one another by snap tabs 82 and 84 on the housing section 74, which securely snap-in to snap windows 86 and 88 on the housing section 76.

The snap spring 46 is illustrated in FIG. 4 in a relaxed state 90, wherein the snap spring 46 is bowed upward away from the snap fingers 48 and 50. The snap spring 46 includes alignment tabs 92 and 94 for alignment with guides 96 and 98 of the housing section 76, such that the snap spring 46 may be properly aligned within the housing section 76. The alignment tabs 92 and 94 may be advantageous for proper installation of the snap spring 46, to provide lateral stability to the snap spring 46 for limiting lateral movement of the snap spring 46 while in operation.

Figure 5:
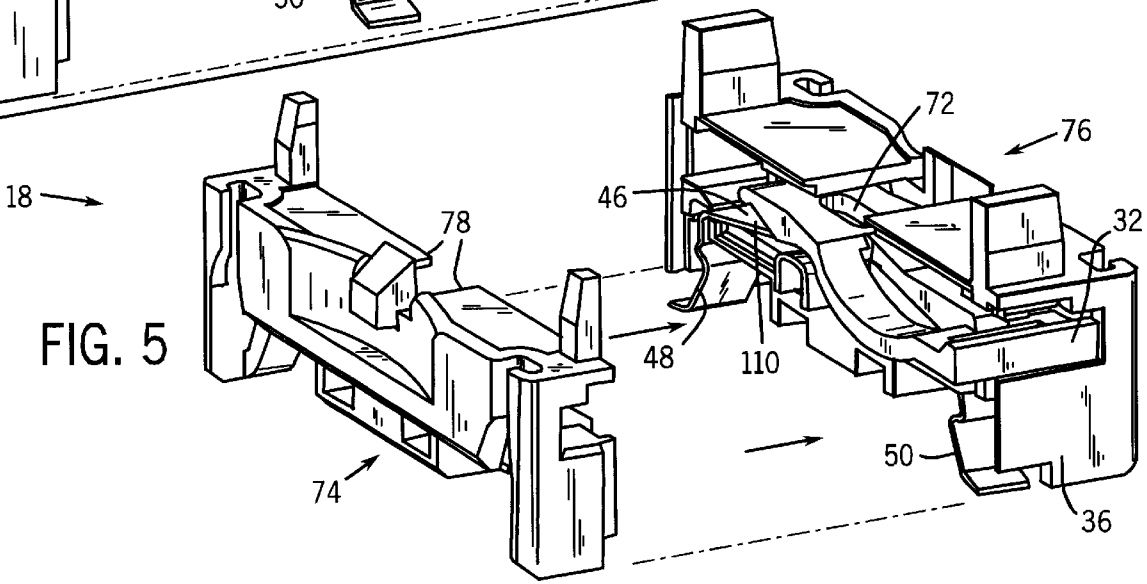
FIG. 5 is a partially exploded perspective view of the head assembly, illustrating the insertion of the snap spring and the actuator into the second housing section.

The actuator 32 has a tab 100, a engagement surface 102 adjacent the tab 100, a cam section 104 adjacent the spring contact surface 102, a support rib 106 adjacent the cam section 104, and a spring slot 108 beneath the support rib 106. FIG. 5 is a partially exploded perspective view of the head assembly 18, illustrating the insertion of the snap spring 46 and the actuator 32 into the housing section 76. The engagement surface 102 contacts a spring surface 110 on the snap spring 46, enabling the actuator 32 to bias the snap spring 46 as the actuator 32 is engaged by the flat elongated member 38 (see, e.g., FIG. 1). As the actuator 32 is laterally moved outwardly from the side 36, the cam section 104 interacts with the housing section 76 and rotates, causing the engagement surface 102 to move downwardly towards the spring surface 110. The actuator 32 and the snap spring 46 are securely, but removably, coupled inside the housing section 76, because the snap spring 46 partially extends into the spring slot 108. This coupling between the snap spring 46 and the spring slot 108 may provide additional stability, as it ensures proper alignment of the actuator 32 on the snap spring 46 during operation. Finally, the support rib 106 provides additional support and rigidity to the actuator 32.

Figure 7:
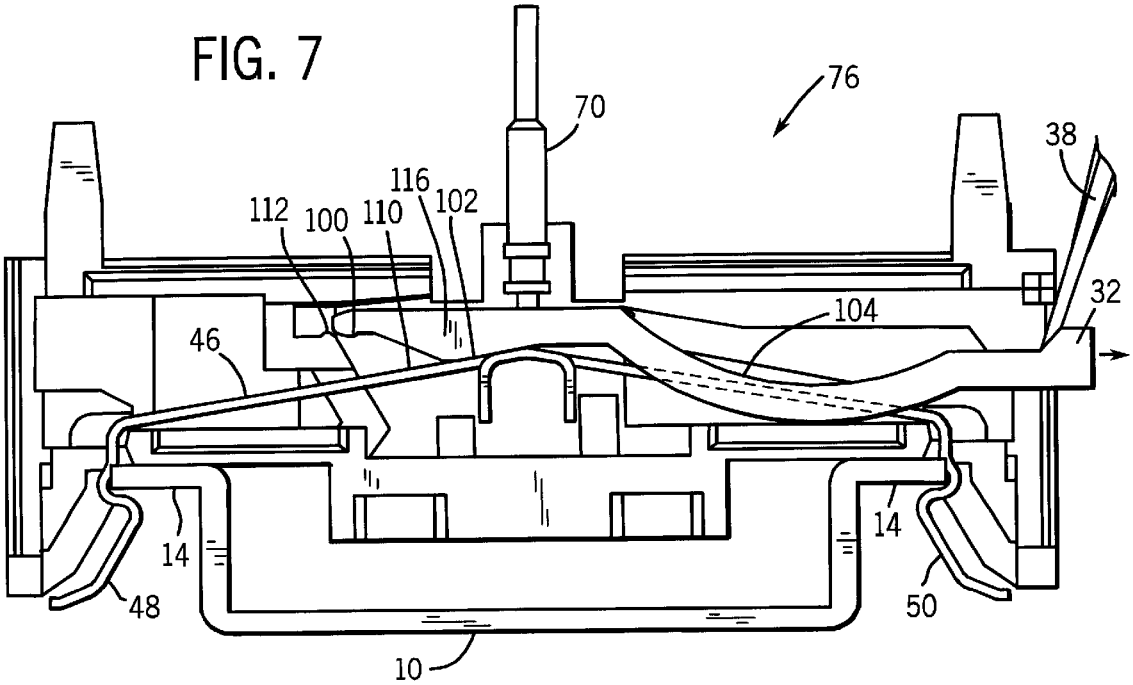
FIG. 7 is a side view of the second housing section illustrating a partially engaged actuator and snap spring, wherein the head assembly is partially disengaged from the DIN rail assembly.
Figure 8:
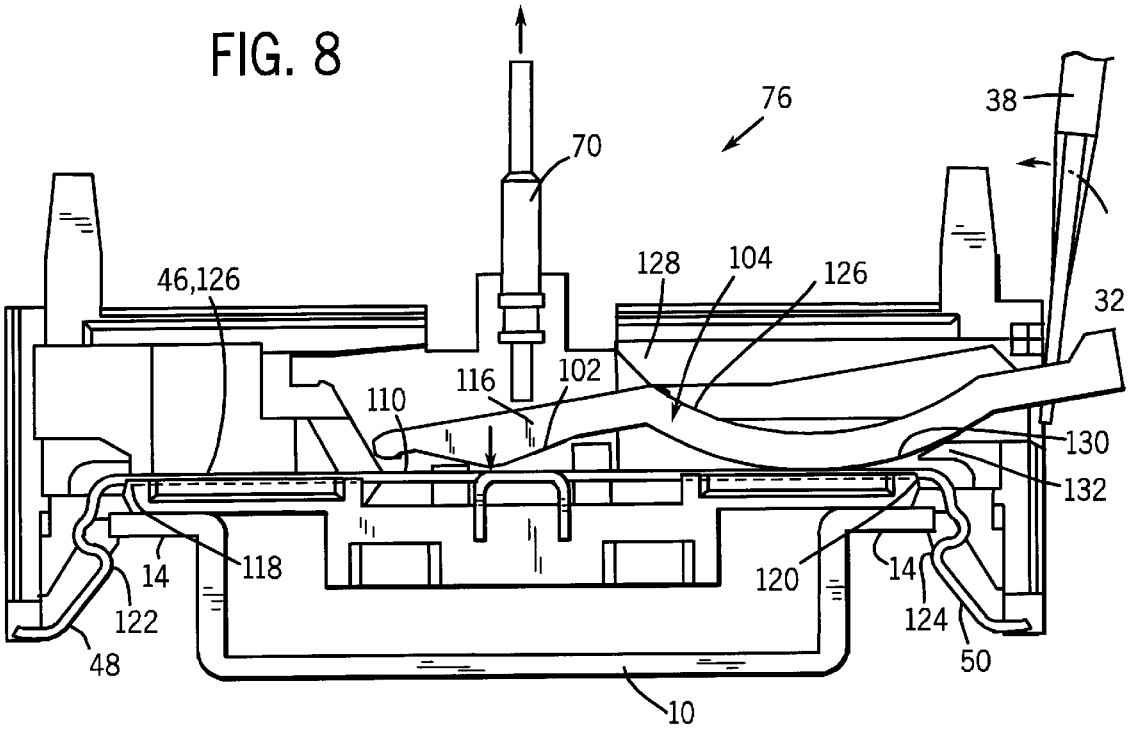
FIG. 8 is a side view of the second housing section illustrating a fully engaged actuator and snap spring, wherein the head assembly is fully disengaged from the DIN rail assembly.

FIGS. 6–8 are side views of the housing section 76 illustrating the operation of the actuator 32, and the interaction between the actuator 32, the snap spring 46, and the housing section 76. FIG. 6 illustrates the head assembly 18 fully attached to the DIN rail assembly 10, prior to engaging the actuator 32 for vertical removal of the head assembly 18. As illustrated, the position of the actuator 32 is maintained primarily by the snap-like interaction between the tab 100 and a ridge 112, and by the wedge-like interaction between the spring surface 110 and the engagement surface 102. The ridge 112 is disposed along a slot 114 in the housing section 76, and removably catches or secures the actuator 32 when the actuator 32 is fully inserted within the housing section 76. In addition, outward motion of the actuator 32 is opposed by the angular contact between the spring surface 110 and the engagement surface 102. The engagement surface 102 is angled because the snap spring 46 is bowed upward to create a spring force against the actuator. Where the spring surface 110 contacts the engagement surface 102, the actuator 32 has a wedge section 116 to oppose outward movement of the actuator 32.

The snap spring 46 contacts the housing section 76 at pivots 118 and 120 of the housing section 76, and removably secures to the DIN rail assembly 10 at ridges 122 and 124 of the snap fingers 48 and 50, respectively. Accordingly, unless the actuator 32 is fully engaged, the ridges 122 and 124 prevent vertical removal of the head assembly 18 from the flanges 14 of the DIN rail assembly 10. In addition, the ground pin 70 maintains continual contact with the snap spring 46, and consequently maintains a continual electrical ground to the DIN rail assembly.

FIG. 7 illustrates the head assembly 18 attached to the DIN rail assembly 10, but with actuator 32 partially engaged and outwardly moved by the flat elongated member 38. As illustrated, the tab 110 has been laterally moved out of the ridge 112, and the wedge section 116 has partially moved along the spring surface 110. As the flat elongated member 38 is further rotated, causing outward movement of the actuator 32, an upper surface 126 of the cam section 104 slides along an upper cam support 128 of the housing section 76 while a lower surface 130 of the cam section 104 slides along a lower cam support 132. This movement causes the actuator 32 to rotate counterclockwise as viewed in the figure, causing the engagement surface 102 to move downward onto the spring surface 110 to depress the snap spring 46 towards a flattened state 134. As the snap spring 46 is depressed, the snap spring 46 pivots and expands outwardly along the pivots 118 and 120, causing the snap fingers 48 and 50 to also expand outwardly from the flanges 14. This outward expansion of the snap fingers 48 and 50 moves the ridges 122 and 124 off of the flanges 14, thereby releasing the head assembly 18 from the DIN rail assembly 10. The head assembly 18 may then be vertically removed from the DIN rail assembly 10. FIG. 8 illustrates the actuator 32 fully engaged by the flat elongated member 38, wherein the snap spring 46 has been fully depressed to the flattened state 134 and the head assembly 18 is ready for vertical removal.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A detachable securement apparatus configured for a mounting rail, the mounting rail having first and second mounting flanges extending lengthwise along opposite sides of a support section, the apparatus comprising:

a body;

a securement assembly having first and second interface members extending from the body, the first and second interface members each including a contact region configured to exert a holding force on the first and second mounting flanges, respectively; and a perpendicular release assembly configured for removing the holding force on both the first and second mounting flanges to allow removal of the body from the mounting rail in a direction at least initially perpendicular with respect to the mounting rail, the release assembly having an engagement member coupled to the body and to the first and second interface members and engagable on a side of the body.

2. The apparatus of claim 1, wherein the body comprises a base configured for coupling with a module assembly.

3. The apparatus of claim 2, wherein the base comprises a coupling assembly for removably coupling with the module assembly.

4. The apparatus of claim 3, wherein the coupling assembly comprises a base snap assembly on a module side of the base, opposite the mounting rail, wherein the base snap assembly is configured for removably snap-fitting with a complementary snap assembly disposed on the module assembly.

5. The apparatus of claim 4, wherein the base snap assembly comprises first and second snap-fit tabs disposed on opposite sides of the base and the complementary snap assembly comprises first and second complementary snap windows disposed on opposite sides of the module assembly.

6. The apparatus of claim 4, wherein the coupling assembly further comprises a support assembly configured for aligning the base with the module assembly, and for resisting rotational movement.

7. The apparatus of claim 6, wherein the support assembly comprises first and second vertical tabs disposed on opposite sides of the base, the first and second vertical tabs configured for removably coupling with a first and second complementary cavity disposed on opposite sides of the module assembly.

8. The apparatus of claim 3, wherein the coupling assembly is symmetrically configured to permit coupling of the base with the module assembly at multiple angular positions.

9. The apparatus of claim 8, wherein the multiple angular positions comprise a normal position and a rotated position wherein the base and the module assembly are rotated 180 degrees with respect to one another.

10. The apparatus of claim 1, the body further comprising a slidable coupling assembly for coupling the body to an adjacent unit having a second body, a second one of the securement assembly, and a second one of the perpendicular release assembly.

11. The apparatus of claim 10, wherein the slidable coupling assembly comprises interlockable slide assemblies symmetrically disposed on opposite sides of the body and the adjacent unit, wherein the slidable coupling assembly is configured to allow vertical attachment and removal of the adjacent unit with the mounting rail.

12. The apparatus of claim 1, wherein the securement assembly further comprises a spring section intermediate the first and second interface members.

13. The apparatus of claim 12, wherein the securement assembly comprises an electrically conductive material.

14. The apparatus of claim 12, wherein the securement assembly further comprising first and second tabs extending from opposite sides of the spring section, and the first and second interface members are disposed on the first and second tabs, respectively.

15. The apparatus of claim 13, wherein the securement assembly is substantially u-shaped.

16. The apparatus of claim 13, wherein the first and second tabs include first and second ridges configured for snapping-on to the first and second mounting flanges, respectively, to secure the body to the mounting rail and prevent vertical movement of the body relative to the mounting rail.

17. The apparatus of claim 16, wherein the first and second ridges are disposed on an inner side of the first and second tabs, and the mounting rail is configured for coupling with the securement assembly at an outer region of the first and second mounting flanges.

18. The apparatus of claim 16, wherein the first and second ridges are disposed on an outer side of the first and second tabs, and the mounting rail is configured for coupling with the securement assembly at an inner region of the first and second mounting flanges.

19. The apparatus of claim 1, wherein the body further comprises a guide assembly for slidably guiding the engagement member to bias the securement assembly.

20. The apparatus of claim 19, wherein the engagement member comprises a cam section slidably coupled to the guide assembly.

21. The apparatus of claim 20, wherein the cam section is substantially u-shaped.

22. The apparatus of claim 1, wherein the engagement member further comprises a locking ridge configured for removably snapping over a complementary ridge disposed on the body.

23. The apparatus of claim 1, wherein the engagement member further comprises a lip section configured for laterally biasing the engagement member with a flat headed tool.

24. The apparatus of claim 1, wherein the body comprises a head unit and a module assembly removably coupled to the head unit, wherein the head unit houses the securement assembly and the perpendicular release assembly.

25. The apparatus of claim 24, further comprising a spring-loaded ground pin assembly for grounding the module assembly to the mounting rail, wherein the spring-loaded ground pin assembly is configured for springably contacting a metallic section of the securement assembly extending to the mounting rail.

26. The apparatus of claim 25, wherein the metallic section is a u-shaped spring assembly having the first and second interface members disposed on opposite sides.

27. A module mounting system for removable mounting to a mounting rail having first and second mounting flanges extending lengthwise along opposite sides of a support section, the system comprising:

a securement assembly having first and second spring-forced feet configured to exert a holding force on the first and second mounting flanges, respectively; and a perpendicular release assembly having a lateral actuator configured to release the first and second spring-forced feet from the mounting rail to allow removal of the securement assembly from the mounting rail in a direction at least initially perpendicular with respect to the mounting rail.

28. The system of claim 27, further comprising a head unit housing the securement assembly and the perpendicular release assembly, the head unit having a snap-fit assembly for removably receiving and coupling with a module assembly.

29. The system of claim 28, further comprising a first module assembly removably coupled to the head unit, and a module interconnect assembly for vertically attaching and detaching the first module assembly and a second module assembly adjacent the first module assembly, the second module assembly including the module interconnect assembly.

30. A method of attachment and detachment with a rail mount assembly, the rail mount assembly having a first and second flange disposed along opposite sides of an elongated support section, the method comprising the acts of:

springably coupling first and second sides of a conductive mounting member to the first and second flange, respectively;

laterally engaging a release actuator coupled to the conductive mounting member; and releasing the first and second sides of the conductive mounting member from the first and second flanges of the rail mount assembly, respectively, in a direction at least initially perpendicular with respect to the rail mount assembly.

31. The method of claim 30, further comprising the act of vertically raising an electronic module comprising the conductive mounting member from the first and second flanges.

32. The method of claim 30, further comprising the act of coupling a module to the mounting member.

33. The method of claim 32, further comprising the act of grounding the module to the rail mount assembly by springably contacting the mounting member with a spring-loaded ground pin extending from the module.

* * * * *